US009567123B2

(12) United States Patent
Mengibar Rivas

(10) Patent No.: US 9,567,123 B2
(45) Date of Patent: Feb. 14, 2017

(54) ROTARY FILLING MACHINE

(71) Applicant: ANTONIO MENGIBAR S.A., Rubi (Barcelona) (ES)

(72) Inventor: Antonio Mengibar Rivas, Cerdanyola del Valles (ES)

(73) Assignee: ANTONIO MENGIBAR S.A., Rubi (Barcelona) (ES)

( * ) Notice: Subject to any disclaimer, the term of this patent is extended or adjusted under 35 U.S.C. 154(b) by 270 days.

(21) Appl. No.: 14/339,973

(22) Filed: Jul. 24, 2014

(65) Prior Publication Data

US 2015/0027585 A1 Jan. 29, 2015

(30) Foreign Application Priority Data

Jul. 24, 2013 (EP) ..... 13382300.5

(51) Int. Cl.

| | |
|---|---|
| ***B65B 43/50*** | (2006.01) |
| ***B65B 3/12*** | (2006.01) |
| ***B65B 43/60*** | (2006.01) |
| *B65B 3/30* | (2006.01) |
| *B65B 39/00* | (2006.01) |

(52) U.S. Cl.

CPC ..... *B65B 43/50* (2013.01); *B65B 3/12* (2013.01); *B65B 43/60* (2013.01); *B65B 3/30* (2013.01); *B65B 2039/009* (2013.01)

(58) Field of Classification Search

CPC ..... B65B 43/50; B65B 43/59; B65B 43/60; B65B 43/62; B65B 3/12; B65B 3/30; B65B 2039/009

USPC ..... 141/144, 148, 168, 171, 172

See application file for complete search history.

(56) References Cited

U.S. PATENT DOCUMENTS

| | | | | |
|---|---|---|---|---|
| 3,892,264 A * | 7/1975 | Held | B67C 3/16 | 141/114 |
| 4,159,028 A * | 6/1979 | Barker | B65B 43/62 | 141/11 |
| 4,966,205 A * | 10/1990 | Tanaka | A45D 40/16 | 141/104 |
| 5,996,652 A * | 12/1999 | Schromm | B65B 3/326 | 141/100 |
| 6,065,508 A * | 5/2000 | Ball | B67C 3/22 | 141/129 |
| 6,516,838 B2 * | 2/2003 | Thibiant | A61K 8/03 | 141/100 |

(Continued)

FOREIGN PATENT DOCUMENTS

ES EP 2639163 B1 * 9/2014 ..... B65B 3/30

*Primary Examiner* — Nicolas A Arnett
(74) *Attorney, Agent, or Firm* — Lucas & Mercanti, LLP

(57) ABSTRACT

Rotary filling machine comprising a rotating infeed starwheel, configured to supply packages, a rotating filling carrousel, upon which a plurality of filling stations are located and; a rotating outfeed starwheel, configured to remove the packages. Each filling station comprises dosage devices; vertical displacement devices configured to vary the relative distance between the package and the dosage devices in the direction of a vertical axis; rotation devices configured to provide relative rotation movement between the package and the dosage devices, around the vertical axis and; horizontal displacement devices configured to vary the relative distance between the package and the dosage devices on a horizontal plane, perpendicular to the vertical axis.

8 Claims, 8 Drawing Sheets

(56) References Cited

U.S. PATENT DOCUMENTS

| | | | | |
|---|---|---|---|---|
| 8,386,072 | B1 * | 2/2013 | Mihalik | B01F 5/0615 700/233 |
| 8,807,176 | B2 * | 8/2014 | Hilliard, Jr. | A45D 40/24 141/105 |
| 9,114,087 | B2 * | 8/2015 | Wei | A61K 8/31 |
| 2010/0006174 | A1 * | 1/2010 | Till | B65B 59/005 141/1 |
| 2013/0255828 | A1 * | 10/2013 | Mengibar Rivas | B65B 3/30 141/9 |

* cited by examiner

ROTARY FILLING MACHINE

CROSS-REFERENCE TO RELATED APPLICATIONS

This application claims the priority of EP 13382300.5 filed Jul. 24, 2013, which is incorporated by reference herein.

OBJECT OF THE INVENTION

The present invention refers to a rotary filling machine, which offers a large number of benefits in the packaging of monophase and multiphase products, at the level of medium and high speed industrial production.

The present invention has been especially designed to be applied to high and medium speed packaging lines in general, which is particularly suited to the packaging of cosmetic, alimentary, pharmaceutical or other home cleaning products, amongst others.

BACKGROUND OF THE INVENTION

The packaging industry is constantly developing in the pursuit of more efficient packaging processes, which are more environmentally friendly and offer a greater level of care and conservation as far as the products to be packaged are concerned. Over recent years, said development has tended decisively towards obtaining new forms of presentation, especially in the cosmetic sector, which combine both the external design of the package itself and the arrangement of the product contained therein, the latter aspect relating directly to filling technologies (machinery and processes).

New forms of presentation bestow various benefits on the packaged products, at both aesthetic and operational level. Aesthetic benefits are particularly relevant, making said products more commercially attractive within an increasingly demanding and selective market. Operational benefits mainly relate to a suitable way of using the product, enabling the various compositions from which it is formed to be conveniently mixed, in order to achieve the optimal effect expected from the same.

Meanwhile, packaging design and filling technologies have been developed in order to find these new forms of presentation. Nevertheless, even if said developments do not seem to present limits in terms of package design, existing filling technologies continue to present significant technical drawbacks.

Therefore, pieces of apparatus which make it possible to fill a package with two or more compositions, which usually have distinct physical and chemical properties, in accordance with a product contained therein, which has a certain filling pattern, is known.

The technology used to this effect constitutes inline fillers, in which all filling stations are aligned and parallel to the production line. These machines only facilitate low and medium speed production, with a maximum of 150 units being produced per minute. These machines operate in an indexing manner. In other words, the various operations or stages (loading packages, filling, unloading packages etc.,) involved are carried out intermittently according to a sequential order. In turn, this simplifies the number of mechanisms and controls, which is why, within the range of speeds within which work can be carried out, it is usually the most profitable option.

Nevertheless, when it comes to filling packages at higher speeds or in other words, filling more than 150 units per minute, with two or more compositions, formed inside a filling pattern, the technical difficulty increases.

In monophase products formed by one single composition and even for multiphase products formed by more than one composition, which do not generate filling patterns but are rather only mixed just before being introduced into the package, this technical jump is achieved using rotary filling machines, also known as "rotary fillers". These machines work continuously or in other words, the various operations or stages (loading packages, filling, unloading packages etc.,) carried out are done so on various packages simultaneously.

The rotary filling machines consist of a filling carrousel, in which the various filling stations, with their corresponding dosage means, are located in the same diameter. Said carrousel rotates constantly. The packages are introduced from the production line to the filling carrousel, known as an "infeed starwheel". The packages are thus deposited on a base, which can be displaced in the direction of a vertical axis. Once the process has come to an end, the packages are extracted from the carrousel by means of an "outfeed starwheel". Both starwheels rotate in synchronisation with the filling carrousel and are tangent with the production line.

A machine formed in a production line in this way is capable of reaching very high speeds (1000 units per minute). The main advantage of it stems from the fact that the package always moves at a constant speed and the machine maintains a constant rotational movement, thus preventing the packages from stopping or being removed alongside the problems resulting in the event of demanding high speeds from inline fillers.

Nevertheless, in contrast to inline fillers, the various operations are not carried out in an index-linked way but rather continuously. As a result, not all the packages are filled at the same time, but rather each one of the packages in the carrousel can be found at a different stage of the filling cycle, for example. The filling stations therefore operate independently. In other words, each one of them should be configured to carry out as many operations as necessary in order to fill each package. Therefore, bearing in mind that the filling stations which make it possible to generate filling patterns require a significant number of operations and have a considerable number of compositions linked to them, their use in rotary filling machines is somewhat complicated at a technical level and gives rise to extremely elevated costs.

Mainly for this reason, the existence of rotary filling machines which facilitate rotational movement between the package and dosage means, around the vertical axis and the possibility of varying the relative distance between the package and the dosage means in a horizontal plane perpendicular to said vertical axis, is not recognised for the filling of packages with two or more compositions, which form a complex filling pattern therein.

The rotary filling machine, object of the present invention, resolves the problems set out above, via a formation which amplifies the relative movements between the package and the dosage means, thus achieving medium and high speed levels of industrial production and a greater number of benefits in the packaging of monophase and multiphase products. It may, for example, improve the distribution of a monophase product, exerting a centrifugal force on the same or create a countless number of filling patterns for a multiphase product in a package.

DESCRIPTION OF THE INVENTION

The rotary filling machine, object of the present invention, is of the variety comprising:

a rotating infeed starwheel, configured to supply packages;

a rotating filling carousel, upon which a plurality of filling stations are arranged diametrically to the same, each one of them being configured to receive a package coming from the infeed starwheel, wherein each filling station comprises:

dosage means configured to administer the dosage of a product inside the package;

vertical displacement means, configured to vary the relative distance between the package and the dosage means, in the direction of a vertical axis and;

a rotating outfeed starwheel configured to remove the packages from the filling carousel, wherein both infeed and outfeed starwheels are configured to rotate in synchronisation with the filling carrousel.

In addition, each filling station comprises:

rotation means, configured to provide a relative rotational movement between the package and the dosage means, around the vertical axis and;

horizontal displacement means, configured to vary the relative distance between the package and the dosage means on a horizontal plane, which is perpendicular to the vertical axis.

Of the wide range of possibilities available for constructing the carrousel, the carrousel preferably comprises:

a central rotating column and;

a first and second disc which are concentric to the central column and joined to the same, arranged in such a way that they are parallel in a lower portion of said column.

The dosage means are preferably configured to administer the dosages of a product, formed by a plurality of compositions, which are supplied separately, it being possible to have two, three, four or more compositions. In accordance with a preferred embodiment, said dosage means comprise:

a measuring unit for each composition, configured to regulate the flow of the same;

a filling head piece, which has an output mouthpiece, configured to administer the dosage of each composition and orientated towards the mouth of the package and;

a distribution channel for each composition, configured to distribute the flow to the measuring unit.

The measuring units are charged with measuring the amount of each composition to be filled at each instant or moment of the process. Those which use dosage cylinders or other positive displacement dosage pumps (peristaltic pumps, gear pumps etc.,) are amongst the most common, in addition to those which use flow meters. The first kind measure the flow by calculating the volume displaced by said positive displacement pumps, for example, the displacement of a piston within a dosage cylinder is known, as well as the volume displaced by the same. In these cases, the pump regulation is carried out by regulating the speed of the corresponding positive displacement pump. The second type use flow meters to measure the flow, whilst they are regulated by means of proportional valves. In order to increase the pressure, closed-loop controls are usually applied between the flow meter and the aperture or close of the proportional valve.

The dosage means preferably comprise a final flexible channel for each composition, configured to facilitate the displacement of the filling head piece on the horizontal plane.

The rotation means are preferably configured to rotate the package on the carrousel, comprising:

a vertical bar joined to the carrousel, coaxial to the vertical axis and with freedom of axial rotation;

a rotation base arranged on an upper end of the vertical bar, configured to receive a package corning from the infeed starwheel and;

a rotation mechanism configured to rotate the vertical bar.

In accordance with one particular embodiment, the vertical bar is arranged perpendicularly between the first disc and second disc, joined to the same via a first lower tread element and a first upper tread element respectively, whilst the rotation mechanism comprises:

a rotation drive, which is joined to the first disc;

a first motor wheel driven by the rotation drive and;

a first driven wheel, concentric to the vertical bar and joined to the same, which engages with the first motor wheel through a first transmission belt, wherein the first motor wheel and the first driven wheel are arranged below said first disc.

In accordance with other design possibilities, the rotation means are configured to rotate the filling head piece in relation to the carrousel, without it being necessary to rotate the package.

The vertical displacement means preferably comprise:

an elevator spindle, joined to the carrousel, parallel to the vertical axis and with freedom of axial rotation;

a vertical transfer cart, crossed by the elevator spindle and which may be displaced along the length of the same, the displacement of which is transmitted to the package and;

an elevator mechanism, configured to rotate the elevator spindle and give rise to the controlled displacement of the vertical transfer cart along the length of said elevator spindle.

In accordance with a particular embodiment, the elevator spindle is arranged perpendicularly between the first disc and second disc, joined to the same via a second lower tread element and a second upper tread element, respectively, whilst the vertical transfer cart is joined to the vertical bar.

In turn, the elevator mechanism comprises:

an elevator drive, which is joined to the first disc;

a second motor wheel, driven by the elevator drive;

a second driven wheel, concentric to the elevator spindle and joined to the same, which engages with the second motor wheel via a second transmission belt, wherein the second motor wheel and the second driven wheel are arranged below said first disc and;

a guide bar located perpendicularly between the first disc and second disc, joined to the same and crossed by the vertical transfer cart, in order to guide the displacement of the same.

The horizontal displacement means are preferably based on the movement of the dosage means on the horizontal plane, the package remaining fixed on said plane. In this sense, the horizontal displacement means comprise:

a lateral spindle parallel to the Y axis of the horizontal plane;

a lateral transfer cart, crossed by the lateral spindle and which may be displaced along the length of the same, the displacement of which is transmitted to the dosage means and;

a lateral displacement mechanism, configured to rotate the lateral spindle and give rise to the controlled displacement of the lateral transfer cart along the length of said lateral spindle.

In turn, the horizontal displacement means comprise:

a front spindle parallel to the X axis of the horizontal plane;

a front transfer cart, crossed by the lateral spindle and which may be displaced along the length of the same, the displacement of which is transmitted to the dosage means and;

a front displacement mechanism, configured to rotate the front spindle and give rise to the controlled displacement of the front transfer cart along; the length of said front spindle.

Of the various possible fixation options for the horizontal displacement means, the lateral transfer cart is preferably joined to the carrousel and to the front transfer cart, whilst said front transfer cart is joined to the filling head piece.

In accordance with other design possibilities, the horizontal displacement means are based on the movement of the package on the horizontal plane, the dosage means remaining fixed.

Both the rotation of the package and the variation of the relative vertical and horizontal distances between the package and the dosage means are carried out in a controlled way, the angle of rotation of the package and the relative vertical and horizontal distances between the same and the mouthpiece being known at all times. For this reason, rotation, vertical displacement and horizontal displacement mechanisms are preferably employed, formed by servomotors that can be controlled in terms of both speed and position.

The control means of the machine, object of the present invention, comprise all automatisms, visualisation devices and devices for introducing operational information, process hardware and software necessary for correct operation and functioning of the method and apparatus of the present invention.

The machine, object of the present invention, makes it possible to perform various movements, namely rotating the package, vertical displacement (Z) and horizontal displacement (X and Y), either simultaneously or alternately. That is to say, depending on the complexity of the filling pattern, any of the following groups of movements may be required in order to obtain it:

a) Rotation+Horizontal displacement (X or Y);
b) Rotation+Horizontal displacement X+Horizontal displacement Y;
c) Vertical displacement Z+Horizontal displacement (X or Y);
d) Vertical displacement Z+Horizontal displacement X+Horizontal displacement Y;
e) Rotation+Vertical displacement Z+Horizontal displacement (X or Y) and;
f) Rotation+Vertical displacement Z+Horizontal displacement X+Horizontal displacement Y.

BRIEF DESCRIPTION OF THE DRAWINGS

Below is a brief description of a series of drawings which facilitate a better understanding of the invention, relating specifically to a preferred embodiment of said invention and providing a non-limiting example thereof.

PREFERRED EMBODIMENT OF THE INVENTION

Figure 1:
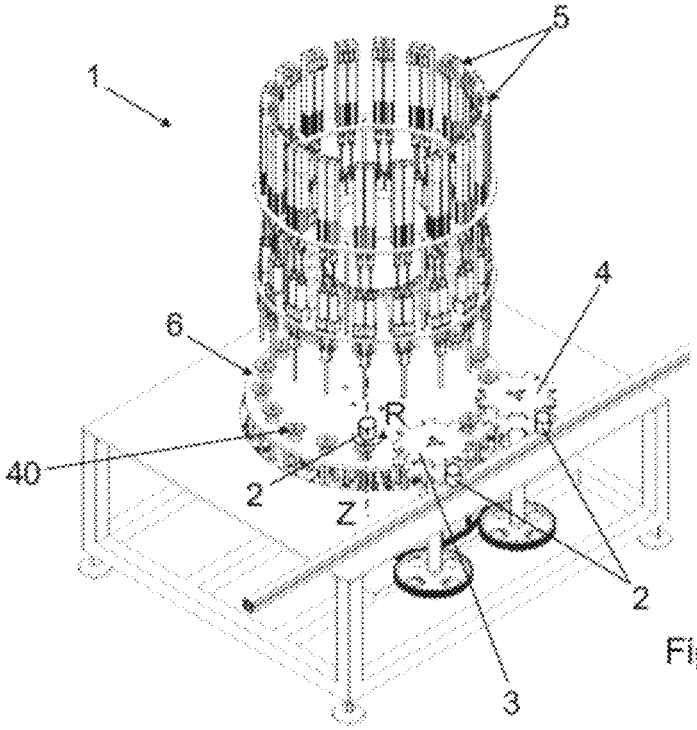
FIG. 1 is a perspective view of the machine, object of the present invention.
Figure 2:
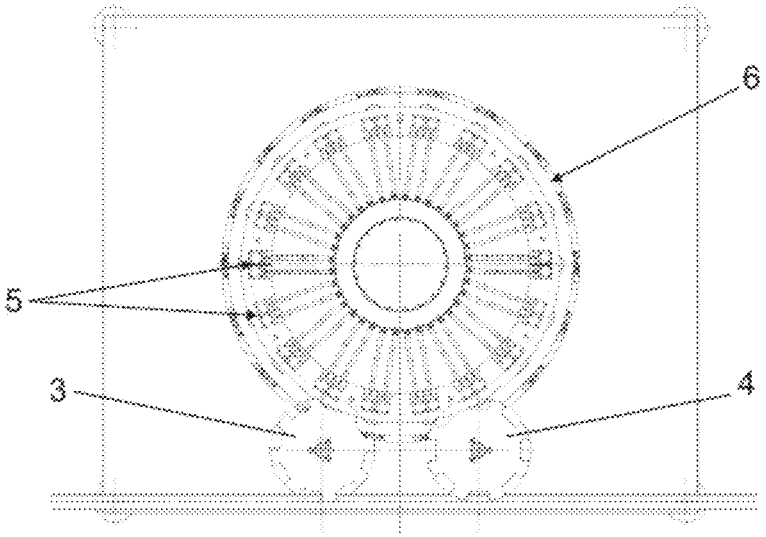
FIG. 2 is a plan view of FIG. 1.
Figure 3:
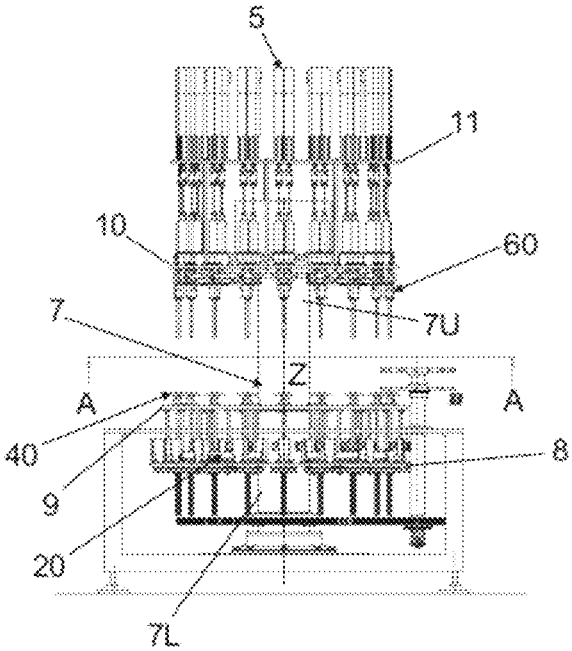
FIG. 3 is a profile view of FIG. 1.

FIGS. 1, 2 and 3 are a perspective, plan and profile view, respectively of the machine (1), object of the present invention. As can be seen, the rotary filling machine object of the present invention, is of the variety comprising:

a rotating infeed starwheel (3), configured to supply packages (2);

a rotating filling carrousel (6), upon which a plurality of filling stations (5) are located diametrically to the same, each one of which is configured to receive a package (2) coming from the infeed starwheel (3), wherein each filling station (5) comprises:

dosage means (60) configured to administer the dosage of a product (100) inside the package (2) (sec FIGS. 12C and 13C) and;

vertical displacement means (20) configured to vary the relative distance between the package (2) and the dosage means (60) in the direction of a vertical axis (Z) and;

a rotating outfeed starwheel (4) configured to remove the packages (2) from the filling carrousel (6), wherein both infeed (3) and outfeed (4) starwheels are configured to rotate in synchronisation with the filling carrousel (6).

In addition, each filling station (5) comprises:

rotation means (40) configured to provide a relative rotation movement (R) between the package (2) and the dosage means (60), around the vertical axis (Z) and;

horizontal displacement means (70) (see FIGS. 7 to 11) configured to vary the relative distance between the package (2) and the dosage means (60) on a horizontal plane (XY) perpendicular to the vertical axis (Z).

A lower portion of the filling station (5) is arranged on a lower portion of the carrousel (6), which in accordance with the present example, comprises:

a central rotating column (7) and;

a first (8) and second disk (9), concentric to the central column (7) and joined to the same, arranged in such a way that they are parallel in a lower portion (7L) of said column (7).

An upper portion of the filling station (5) is arranged on an upper portion of the carrousel (6), which in accordance with the present example, comprises:

a third (10) and fourth (11) disc concentric to the central column (7) and joined to the same, arranged in such a way that they are parallel in an upper portion (715) of said column (7).

Figure 4:
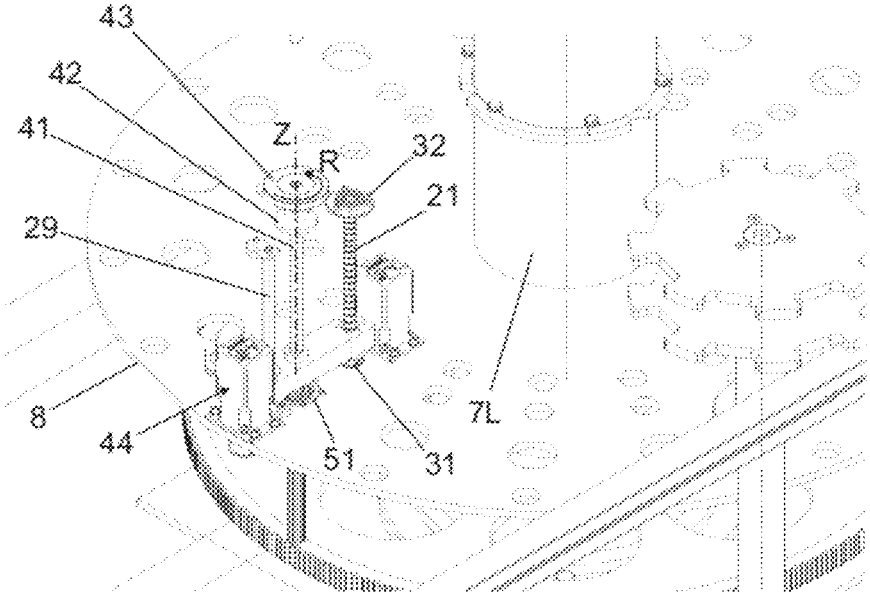
FIG. 4 is a perspective view of the rotation means and vertical displacement of a filling station.
Figure 5:
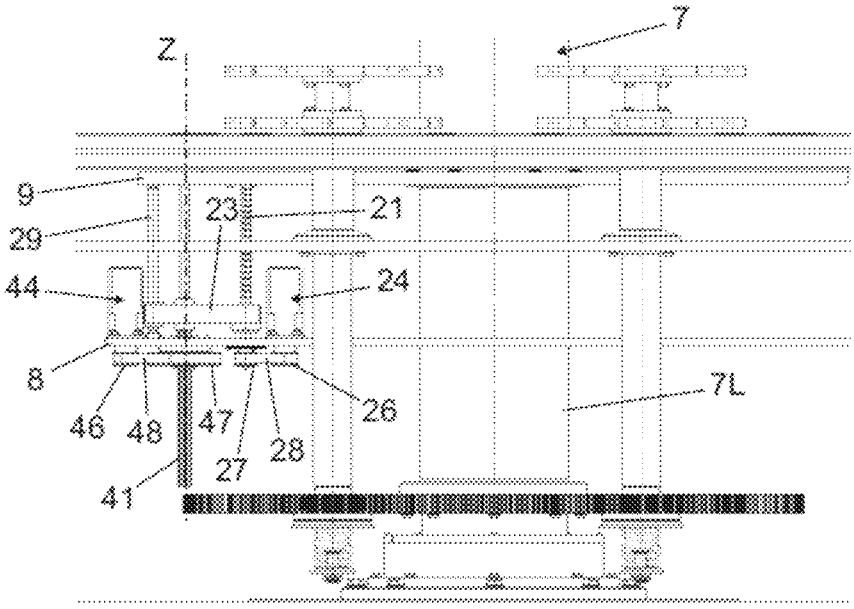
FIG. 5 is a profile view of the rotation means of a filling station.
Figure 6:
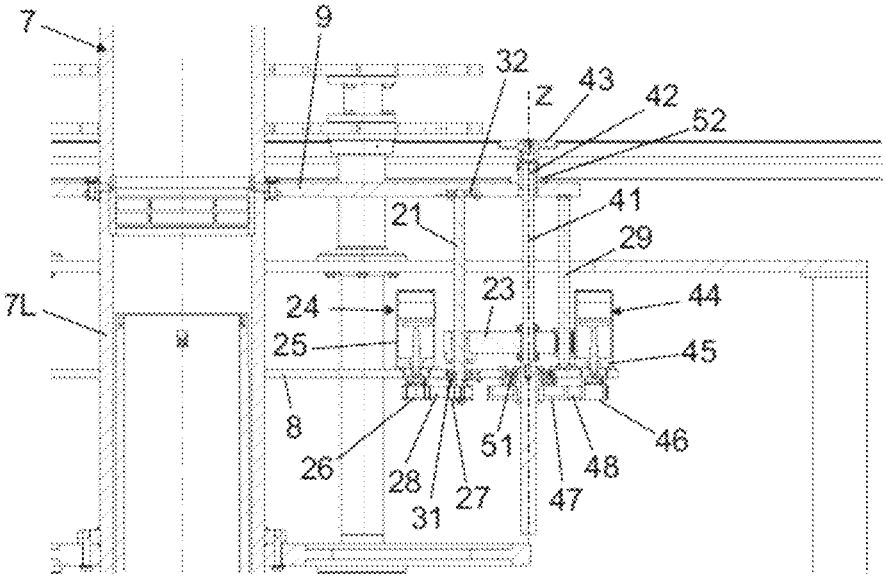
FIG. 6 is a longitudinal cross-section of the rotation means of a filling station.

FIGS. 4, 5 and 6 illustrate the rotation means (40) and vertical displacement means (60) of a filling station (5) in more detail. As can be seen, the rotation means (40) are configured to rotate the package (2) on the carrousel (6), comprising:

a vertical bar (41) joined to the carrousel (6), coaxial to the vertical axis (Z) with freedom of axial movement;

a rotation base (43) arranged on an upper end (42) of the vertical bar (41), configured to receive a package (2) coming from the infeed starwheel (3) and;

a rotation mechanism (44), configured to rotate the vertical bar (41).

The vertical bar (41) is arranged perpendicularly between the first disc (8) and the second disc (9), joined to the same via a first lower tread element (51) and a first upper tread element (52), respectively, whilst the rotation mechanism (44), comprises:

a rotation drive (45), which is joined to the first disc (8);

a first motor wheel (46) driven by the rotation drive (45) and;

a first driven wheel (47), concentric to the vertical bar (41) and joined to the same, which engages with the first motor wheel (46) via a first transmission belt (48), wherein the first motor wheel (46) and the first driven wheel (47) are arranged below said first disc (8).

In turn, the vertical displacement means (20) comprise:

an elevator spindle (21) joined to the carrousel (6), parallel to the vertical axis (Z) and with freedom of axial rotation;

a vertical transfer cart (23), crossed by the elevator spindle (21) and which may be displaced along the length of the same, the displacement of which is transmitted to the package (2) and;

an elevator mechanism (24) configured to rotate the elevator spindle (21) and give rise to the controlled displacement of the vertical transfer cart (23) along the length of said elevator spindle (21).

The elevator spindle (21) is arranged perpendicularly between the first disc (8) and the second disc (9), joined to the same via a second lower tread element (31) and a second upper tread element (32) respectively, whilst the vertical transfer cart (23) is joined to the vertical bar (41).

In turn, the elevator mechanism (24) comprises:

an elevator drive (25), which is joined to the first disc (8);

a second motor wheel (26) driven by the elevator drive (25);

a second driven wheel (27), concentric to the elevator spindle (21) and joined to the same, which engages with the second motor wheel (26) via a second transmission belt (28), wherein the second motor wheel (26) and the second driven wheel (27) are arranged below said first disc (8) and;

a guide bar (29) which is arranged perpendicularly between the first disc (8) and the second disc (9) in such a way that it is joined to the same, crossed by the vertical transfer cart (23), in order to guide the displacement of the same.

Figure 7:
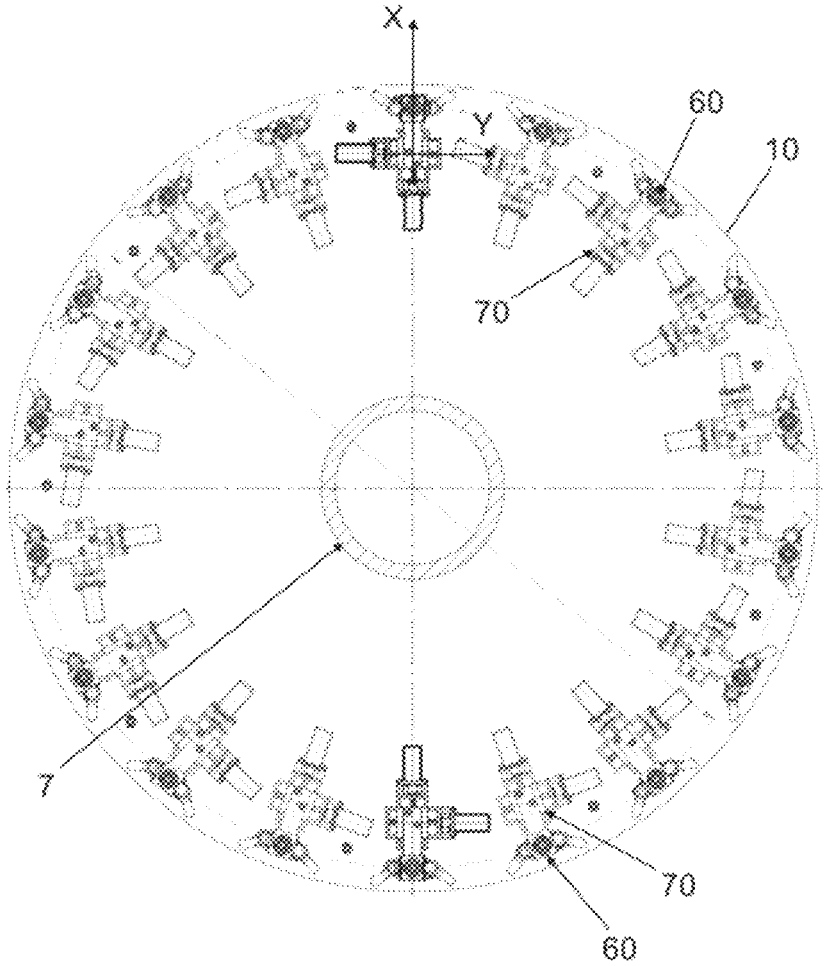
FIG. 7 is a sectioned view of FIG. 3, according to the cut line A-A.

FIG. 7 shows how the filling stations (5) are arranged in relation to the carrousel (6), wherein the dosage means (60) and horizontal displacement means (70) can be observed.

Figure 8:
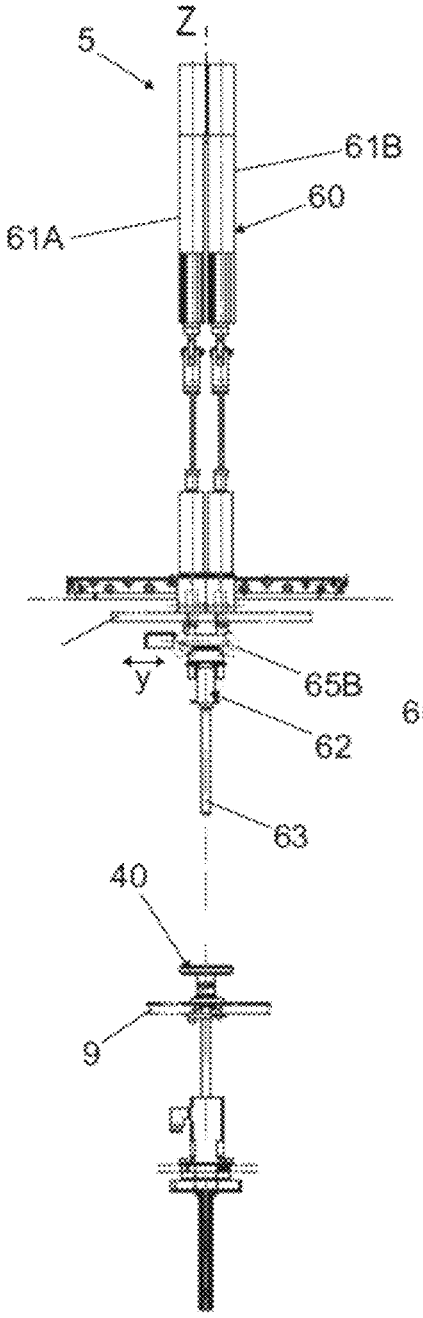
FIG. 8 is a front view of a filling station.
Figure 9:
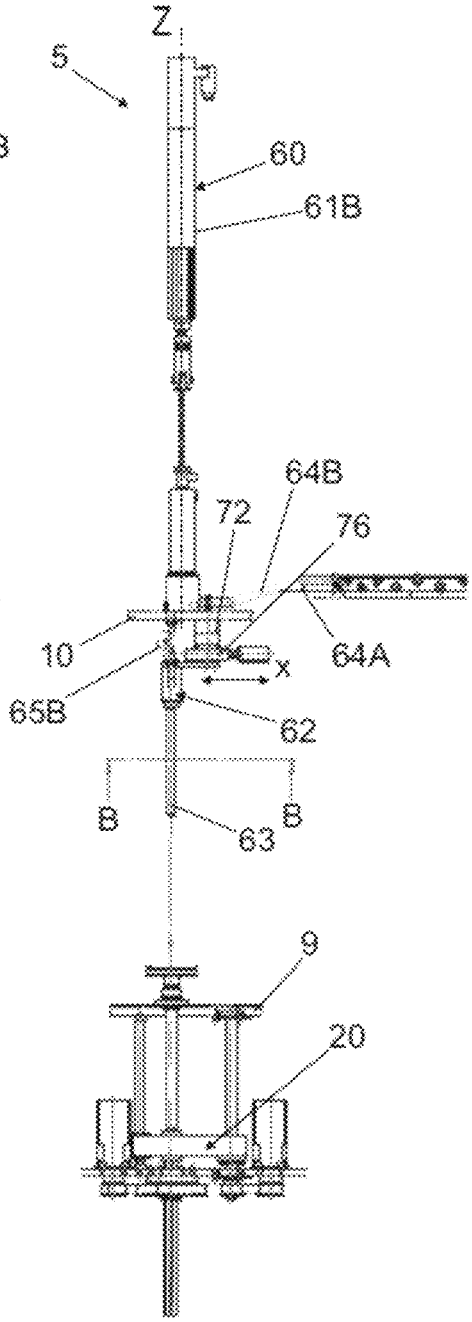
FIG. 9 is a profile view of a filling station.

FIGS. 8 and 9 are more detailed representations of the dosage means (60). As can be seen, they are configured to administer the dosage of a product (100), formed by a plurality of compositions (100A, 100B), which are supplied separately (see FIGS. 12A and 13A). The dosage means (60) comprise:

a measuring unit (61A, 61B) for each composition (100A, 100B), configured to regulate the flow of the same;

a filling head piece (62) which has an output mouthpiece (63), configured to administer the dosage of each composition (100A, 100B), which, is orientated towards the mouth of the package (2) and;

a distribution channel (64A, 64B) for each composition (100A, 100B), configured to distribute the flow to the measuring unit (61A, 61B).

In turn, the dosage means (60) comprise a final flexible channel (65A, 65B) for each composition (100A, 100B), configured to facilitate the displacement of the filling head piece (62) on the horizontal plane (XY).

Figure 10:
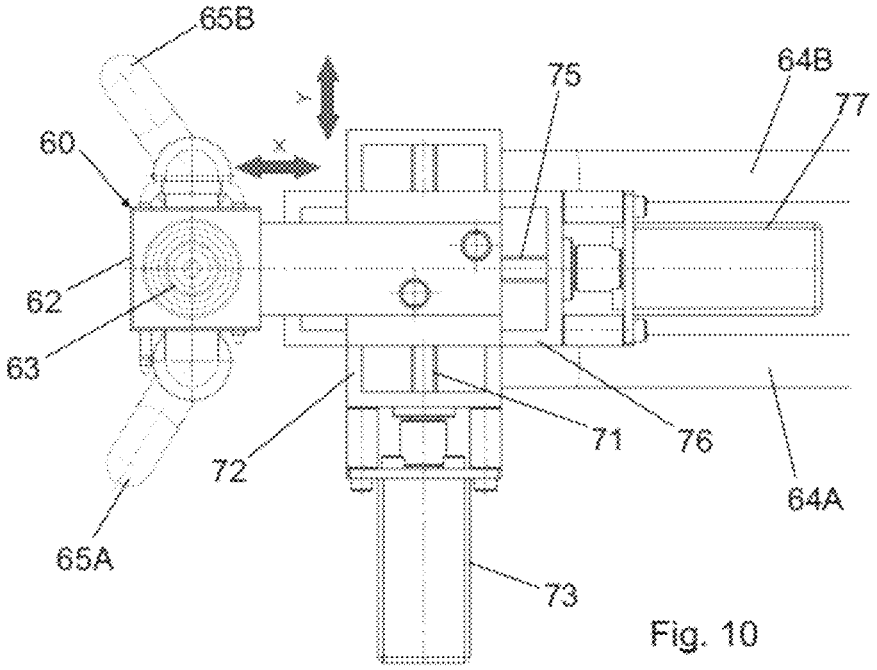
FIG. 10 is a sectioned view of FIG. 9, according to the cut line B-B.
Figure 11:
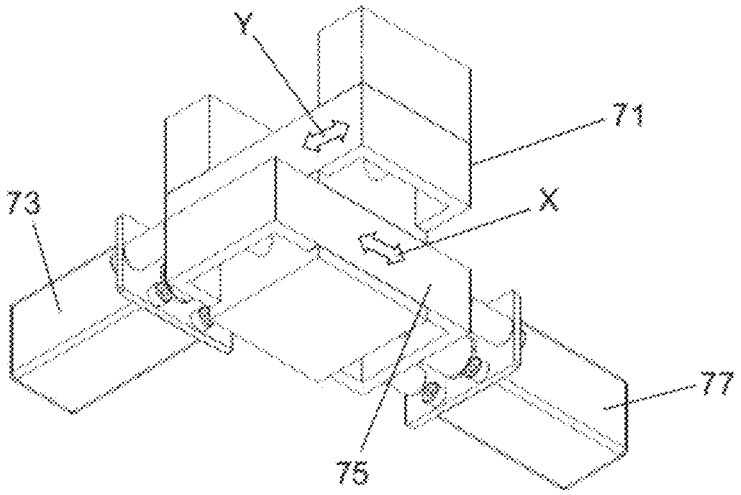
FIG. 11 is a perspective view of a detail of the horizontal displacement means.

FIGS. 10 and 11 represent the horizontal displacement (70) in greater detail. As can be seen, in accordance with the present example, they are based on the movement of the dosage means (60) on the horizontal plane (XY), the package (2) remaining fixed on said plane. In this sense, the horizontal displacement means (70) comprise:

a lateral spindle (71), parallel to the Y axis of the horizontal plane (XY);

a lateral transfer cart (72), crossed by the lateral spindle (71), which may be displaced along the length of the same, the displacement of which is transmitted to the dosage means (60) and;

a lateral displacement mechanism (73), configured to rotate the lateral spindle (71) and give rise to the controlled displacement of the lateral transfer cart (72) along the length of said lateral spindle (71).

In turn, the horizontal displacement means (70) comprise:

a front spindle (75) parallel to the X axis of the horizontal plane (XY);

a front transfer cart (76) crossed by the lateral spindle (75), which may be displaced along the length of the same, the displacement of which is transmitted to the dosage means (60) and;

a front displacement mechanism (77), configured to rotate the front spindle (75) and give rise to the controlled displacement of the front transfer cart (76) along the length of said front spindle (75).

Of the various possible fixation options for the horizontal displacement means (70), the lateral transfer cart (72) is preferably joined to the carrousel (6) and to the front transfer cart (76), whilst said front transfer cart (76) is joined to the filling head piece (62).

Figure 12A:
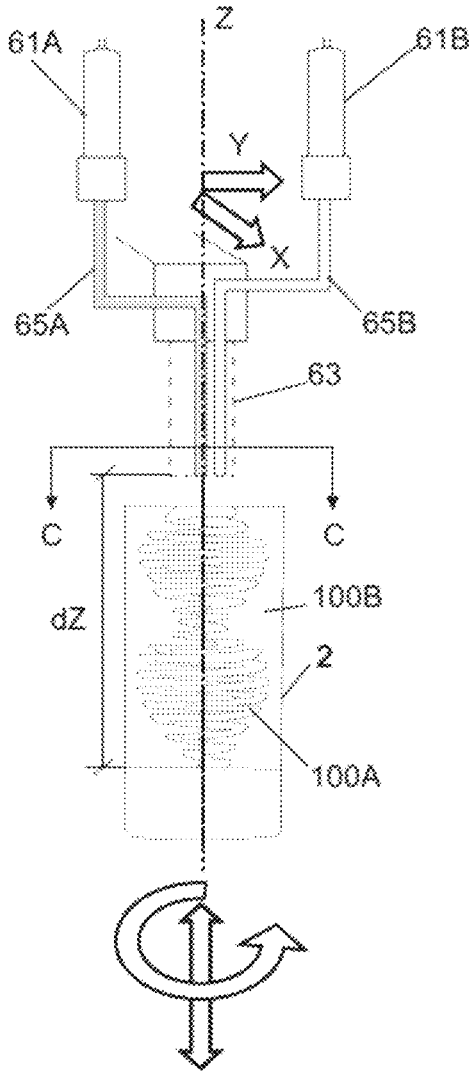
FIG. 12A is a front schematic view of the generation of a first example of a filling pattern.

FIG. 12A is a front schematic view of the generation of a first example of a filling pattern. Arrows have been used in this figure to indicate the direction of all of the movements involved in generating it. According to this first example, the filling pattern has a first composition (100A) with a helical form variable diameter, along the length of the package (2), absorbed in a second composition (100B).

The relative vertical distance (dZ) between the package (2) and the output mouthpiece (63) in the direction of the vertical axis (Z) varies from the bottom of the package (2) to beyond its mouth, according to the level represented in said figure.

Figure 12B:
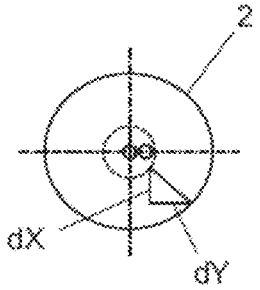
FIG. 12B is a sectioned view of FIG. 12A, according to the cut line C-C.

In FIG. 12B, it is possible to observe that the relative horizontal distance (dX, dY) between the package (2) and the output mouthpiece (63) varies from the internal contour of the package (2) to the external contour of the mouthpiece (63). In the mouthpiece (63) section, it is possible to observe the openings through which the dosage of each composition (100A, 100B) is administered.

Figure 12C:
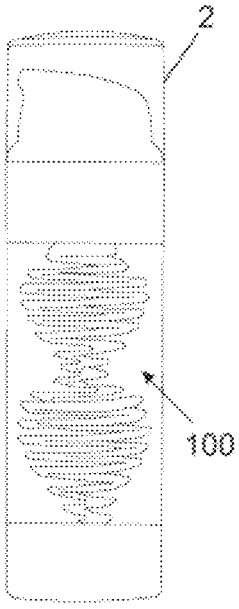
FIG. 12C is a side view of a package, which shows the result of applying the first example of a filling pattern.

FIG. 12C is a lateral view of the result obtained using this first example of a filling pattern.

Figure 13A:
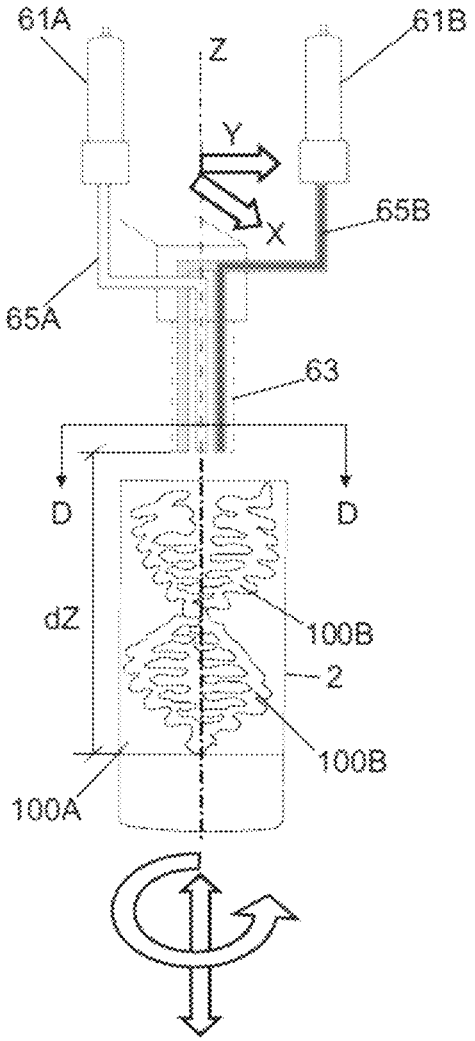
FIG. 13A is a front schematic view of the generation of a second example of a filling pattern.

FIG. 13A is a front schematic view of the generation of a second example of a filling pattern (100). Arrows are contained therein in order to represent the direction of all the movements involved in generating it. According to this second example, the filling pattern has a first composition (100B), divided into at least two parts absorbed in a second composition (100A).

The relative vertical distance (dZ) between the package (2) and the output mouthpiece (63) in the direction of the vertical axis (Z) varies from the bottom of the package (2) to beyond its mouth, according to the level shown in said figure.

Figure 13B:
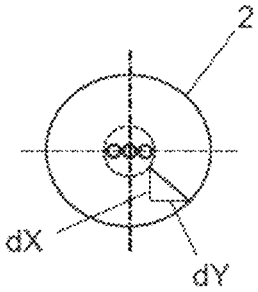
FIG. 13B is a sectioned view of FIG. 13A, according to the cut-line D-D.
Figure 13C:
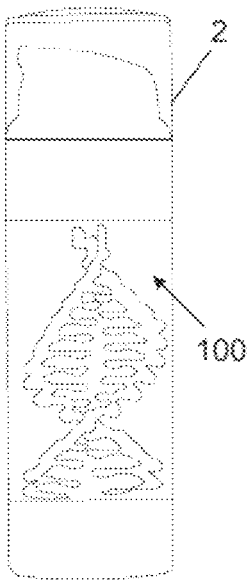
FIG. 13C is a side view of a package which shows the result of applying the second example of a filling pattern.

In FIG. 13B, it is possible to observe that the relative horizontal distance (dX, dY) between the package (2) and the output mouthpiece (63) varies from the internal contour of the package (2) to the external contour of the mouthpiece (63). In the mouthpiece (63) section, it is possible to observe the openings through which the dosage of each composition (100A, 100B) is administered. The dosage of the first composition (100A) is administered through the two lateral openings.

FIG. 13 C is a side view of the result obtained using this second example of a filling pattern.

The invention claimed is:

1. A rotary filling machine, comprising:

a rotating infeed starwheel configured to supply packages;

a rotating filling carrousel upon which a plurality of filling stations are arranged diametrically to the same, each one of which is configured to receive a package coming from the infeed starwheel, wherein each filling station comprises:

a dosage device, configured to administer the dosage of a product inside the package and;

a vertical displacement device configured to vary the relative distance between the package and the dosage device in the direction of a vertical axis;

a rotating outfeed starwheel, configured to remove the packages from the filling carrousel, wherein both infeed and outfeed starwheels are configured to rotate in synchronization with the filling carrousel;

wherein each of the plurality of the filling stations further comprises:

a rotation device, configured to provide a relative rotation movement between the package and the dosage device, around the vertical axis, wherein the rotation device is configured to rotate the package in relation to the carrousel, and wherein the rotation device comprises:

a vertical bar joined to the carrousel, which is coaxial to the vertical axis and has freedom of axial rotation, wherein the vertical bar is arranged perpendicularly between a first disc and a second disc, joined via a first lower tread element and a first upper tread element, respectively;

a rotation base arranged on an upper end of the vertical bar, configured to receive a package coming from the infeed starwheel and;

a rotation mechanism, configured to rotate the vertical bar, wherein the rotation mechanism comprises:

a rotation drive which is joined to the first disc;

a first motor wheel driven by the rotation drive and;

a first driven wheel concentric to the vertical bar and joined to the same, which engages with the first motor wheel via a first transmission belt, wherein the first motor wheel and the first driven wheel are arranged below said first disc and;

a horizontal displacement device, configured to vary the relative distance between the package and the dosage device on a horizontal plane perpendicular to the vertical axis.

2. The rotary filling machine according to claim 1, wherein the dosage device is configured to administer the dosage of a product formed by a plurality of compositions which are supplied separately.

3. The rotary filling machine according to claim 2, wherein the dosage device comprises:

a measuring unit for each composition, configured to regulate the flow of the same;

a filling head piece, which has an output mouthpiece, configured to administer the dosage of each composition and which is orientated towards the mouth of the package and;

a distribution channel for each composition, configured to distribute the flow to the measuring unit.

4. The rotary filling machine according to claim 3, wherein the dosage device comprises a final flexible channel for each composition, configured to facilitate the displacement of the filling head piece on the horizontal plane.

5. A rotary filling machine, comprising:

a rotating infeed starwheel configured to supply packages;

a rotating filling carrousel, wherein the carrousel comprises:

a central rotating column;

a first and second disc, concentric to the central column and joined to the same, arranged in such a way that they are parallel in a lower portion of said column; and wherein a plurality of filling stations are arranged diametrically to the same, each one of which is configured to receive a package coming from the infeed starwheel, wherein each filling station further comprises:

a rotation device, configured to provide a relative rotation movement between the package and the dosage device, around the vertical axis and;

a horizontal displacement device, configured to vary the relative distance between the package and the dosage device on a horizontal plane perpendicular to the vertical axis;

a dosage device, configured to administer the dosage of a product inside the package and;

a vertical displacement device configured to vary the relative distance between the package and the dosage device in the direction of a vertical axis, wherein each of the vertical displacement devices comprises:

an elevator spindle joined to the carrousel, which is parallel to the vertical axis and has freedom of axial rotation, wherein the elevator spindle is arranged perpendicularly between the first disc and the second disc, joined to the same via a second lower tread element and a second upper tread element respectively;

a vertical transfer cart, crossed by the elevator spindle, which can be displaced along the length of the same, the displacement of which is transmitted to the package, wherein the vertical transfer cart is joined to the vertical bar and;

an elevation mechanism configured to rotate the elevator spindle and give rise to the controlled displacement of the vertical transfer cart along the length of said elevator spindle; and a rotating outfeed starwheel, configured to remove the packages from the filling carrousel, wherein both infeed and outfeed starwheels are configured to rotate in synchronisation with the filling carrousel.

6. The rotary filling machine according to claim 5, wherein the elevator mechanism comprises:

an elevator drive, which is joined to the first disc;

a second motor wheel, driven by the elevator drive;

a second driven wheel, concentric to the elevator spindle and joined to the same, which engages with the first motor wheel, via a second transmission belt, wherein the second motor wheel and the second driven wheel are arranged below said first disc and;

a guide bar, which is arranged perpendicularly between the first disc and the second disk, in such a way that it is joined to the same, crossed by the vertical transfer cart, in order to guide the displacement of the same.

7. A rotary filling machine, comprising:

a rotating infeed starwheel configured to supply packages;

a rotating filling carrousel upon which a plurality of filling stations are arranged diametrically to the same, each one of which is configured to receive a package coming from the infeed starwheel, wherein each filling station comprises:

a dosage device, configured to administer the dosage of a product inside the package and;

a vertical displacement device configured to vary the relative distance between the package and the dosage device in the direction of a vertical axis and;

a rotating outfeed starwheel, configured to remove the packages from the filling carrousel, wherein both infeed and outfeed starwheels are configured to rotate in synchronization with the filling carrousel;

wherein each of the plurality of filling stations further comprises:

a rotation device, configured to provide a relative rotation movement between the package and the dosage device, around the vertical axis and;

a horizontal displacement device, configured to vary the relative distance between the package and the dosage device on a horizontal plane perpendicular to the vertical axis, wherein the horizontal displacement device comprises:

a lateral spindle parallel to the Y axis of the horizontal plane;

a lateral transfer cart, crossed by the lateral spindle, which may be displaced along the length of the same and the displacement of which is transferred to the dosage device and;

a lateral displacement mechanism, configured to rotate the lateral spindle and give rise to the controlled displacement of the lateral transfer cart along the length of said lateral spindle, a front spindle parallel to the X axis of the horizontal plane;

a front transfer cart, crossed by the lateral spindle which may be displaced along the length of the same, the displacement of which is transferred to the dosage device and;

a front displacement mechanism, configured to rotate the front spindle and give rise to the controlled displacement of the front transfer cart along the length of said front spindle.

8. The rotary filling machine according to claim 7, wherein the lateral transfer cart is joined to the carrousel and to the front transfer cart and wherein said front transfer cart is joined to a filling head piece.

* * * * *